US007115804B1

(12) United States Patent
Campbell

(10) Patent No.: US 7,115,804 B1
(45) Date of Patent: Oct. 3, 2006

(54) ADJUSTABLE CHANTER FOR BAGPIPES

(76) Inventor: Kyle Campbell, c/o 680 Moray Street, Winnipeg, Manitoba (CA) R3J 3S3

( * ) Notice: Subject to any disclaimer, the term of this patent is extended or adjusted under 35 U.S.C. 154(b) by 0 days.

(21) Appl. No.: 11/269,891

(22) Filed: Nov. 9, 2005

(51) Int. Cl.
*G10D 7/00* (2006.01)

(52) U.S. Cl. ..... 84/380 B; 84/380 R

(58) Field of Classification Search ..... 84/380 B, 84/380 R, 386; D17/10
See application file for complete search history.

(56) References Cited

U.S. PATENT DOCUMENTS 1,821,655 A 9/1931 Loomis
1,837,227 A 12/1931 Lomis
2,098,457 A 11/1937 Lomis
2,485,021 A 10/1949 Strupe
6,031,168 A * 2/2000 Damm ..... 84/380 B
2003/0075035 A1* 4/2003 Ross et al. ..... 84/380 B

* cited by examiner

*Primary Examiner*—Kimberly Lockett
(74) *Attorney, Agent, or Firm*—Adrian D. Battison; Michael R. Williams; Ryan W. Dupuis

(57) ABSTRACT

An adjustable chanter for mounting in an outlet tube of a set of bagpipes includes a conventional reed and a conventional chanter pipe having a series of finger holes by which notes can be selected. The chanter pipe has a collar at an upper end which is screw fastened to a hub defining a sleeve arranged which extends from the upper end of the chanter pipe into the tube of the set of bagpipes as a friction fit within the tube such that the hub is supported in the tube for receiving air through the tube from the bag for passing through the pipe for playing the notes. The position of the mouth of the reed relative to the holes in the chanter pipe is adjusted by a shuttle which slides longitudinally in the hub moved by a manually operable shaft projecting from the hub to one side and manually rotatable so that the reed can be adjusted to change tuning without rotating the chanter pipe or removing the chanter pipe from the tube of the bag.

12 Claims, 5 Drawing Sheets

ADJUSTABLE CHANTER FOR BAGPIPES

This invention relates to an adjustable chanter for bag pipes which can be adjusted without removing the chanter from the outlet tube of the bag.

BACKGROUND OF THE INVENTION

Conventional bag pipes include a bag with a series of outlet tubes fastened into the bag so that the air in the bag escapes through the tubes into either the chanter or the drones. The chanter comprises a pipe with holes at spaced positions which change the note generated by a vibrating reed located in the chanter and supported by the chanter in the outlet tube.

At this time, adjustment of the tuning is obtained by removing the chanter from the tube by pulling it from its friction fit within the tube whereupon the reed is exposed and can itself be removed from the end of the chanter and adjusted in position relative to the end of the chanter by selecting an amount of wrapping and the location of the friction fit of the reed in its holder in the chanter. This is difficult, potentially damaging to the delicate reed and requires repeated trial and error.

Bagpipes are very susceptible to changes in moisture and other environmental conditions so that they require repeated tuning, at least to the trained and skilled ear.

Prior art arrangements for other types of musical instruments which are not designed for and not suitable for bag pies are shown in U.S. Pat. Nos. 2,485,021 (Strupe) issued May 1946; 2,098,457 ( ) issued; 1,837,227 ( ) issued and 1,821,655 ( ) issued. In the first, second and third arrangements described above, the instrument is adjusted by rotation of one element relative to another about the axis of the pipe. The older patented designs will cause the pitch tone to be adjusted while the chanter is being removed from the pipe stock because of the twisting effect that is required to perform this task.

SUMMARY OF THE INVENTION

It is one object of the invention to provide a chanter for a set of bag pipes which can be adjusted in tuning without removing the chanter from the tube of the bag.

According to one aspect of the invention there is provided a chanter for mounting in an outlet tube of a set of bagpipes comprising:

a chanter pipe having a series of finger holes by which notes can be selected;

the chanter pipe having a collar at an upper end;

a hub having a hub body for attachment to the collar;

the hub having a sleeve arranged such that the sleeve extends from the upper end of the chanter pipe for insertion into the tube of the set of bagpipes with an outer surface of the sleeve providing a friction fit within the tube such that the hub is supported in the tube for receiving air through the tube from the bag for passing through the pipe for playing the notes;

a shuttle mounted in the sleeve so as to be held in the sleeve against side to side movement within the sleeve;

the shuttle having a hollow bore therethrough to allow the air to pass from the tube to the chanter pipe;

the shuttle having an inner cylindrical surface at an upper end for engaging and receiving an outer surface of a reed, such that the reed, when inserted, is held in fixed position in the shuttle with a mouth of the reed above an upper end of the shuttle so as to supported within the tube for generating a vibration in air passing through the tube to the chanter pipe for generating the notes;

the shuttle being slidable longitudinally of the hub so as adjust the distance of the mouth of the reed from the holes in the chanter pipe to change tuning of the chanter pipe;

and an adjustment member mounted on the hub which is manually actuable by manual movement relative to the hub to drive sliding movement of the shuttle within the hub to effect the change of the tuning.

The proposed design, as defined above, will allow an operator to remove the chanter from the stock without compromising the pitch tone during a required twisting action.

In a particularly preferred arrangement, the way in which this invention can perform the mentioned task is due to the design of the adjustment tool at a 90 degree angle from the tube of the chanter.

Preferably the shuttle is held against rotation relative to the hub.

Preferably the adjustment member projects outwardly to one side of the hub.

Preferably the adjustment member is rotatable about an axis transverse to the axis of the chanter pipe.

Preferably the chanter pipe is maintained in fixed position relative to the hub while the adjustment member is operated to effect the change of the tuning.

Preferably the adjustment member includes a shaft extending into the hub along an axis transverse to the axis of the chanter pipe.

In one preferred arrangement, the shaft carries a screw which acts to rotate a pinion within the hub, there being provided a screw coupling between the pinion and the shuttle such that rotation of the pinion drives the longitudinal movement of the shuttle.

In this preferred arrangement, the pinion includes a sleeve surrounding the shuttle and the screw coupling is provided between the sleeve and an outer surface of the shuttle.

In another preferred arrangement, the shaft carries a friction drive collar which engages an outer surface of the shuttle such that rotation of the friction drive collar against the outer surface of the shuttle acts to move the shuttle longitudinally.

The shaft may be moveable along its length so as to move the friction drive collar away from the shaft and to move into engagement with the shuttle a movement locking member.

Preferably the shuttle is shaped and arranged to receive a conventional reed and to hold the reed in fixed position relative to the shuttle.

Preferably the collar of the chanter pipe is fastened to the hub by screws extending parallel to the axis of the chanter pipe.

Thus the arrangement defined above provides a system that can be added to a modified version of the structure of a traditional Highland Bagpipe Chanter. It allows the operator to adjust pitch tone of the reed without removing the chanter from the bagpipe stock, which is the traditional operation. The system utilized in this invention is one that the reed seats into the chanter and can be moved up or down through the use of a tool located on the outside of the chanter body. By moving the reed up or down, the distance from the bottom of the reed to the top of the finger hole is altered—therefore changing the pitch.

This invention will allow a musician to adjust tone while the chanter is mounted into its stock therefore less reed damage shall be incurred. The musician can keep the pipe bag full of air at any given time during the adjustment of tone—therefore the chanter can be tuned while playing with another instrument or when using a tuner.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
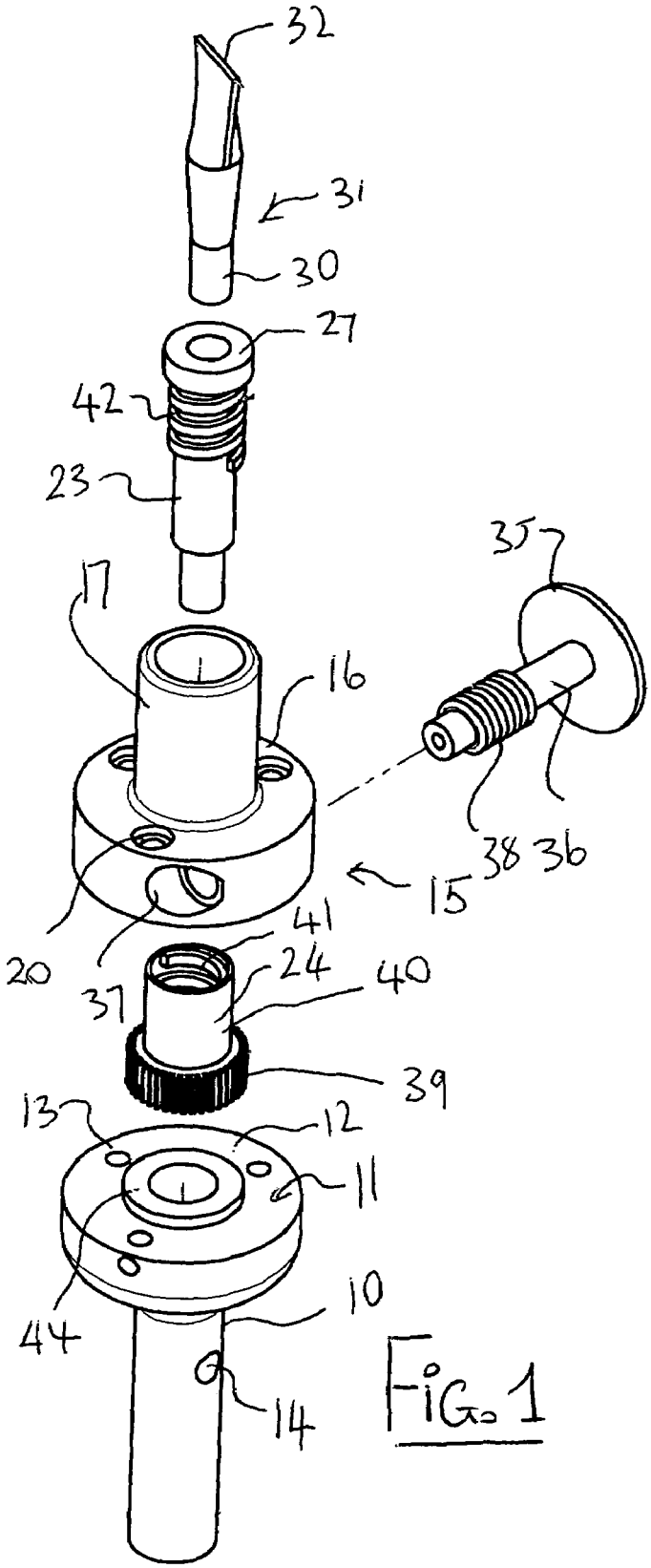
FIG. 1 is an exploded view of a first embodiment of adjustable chanter for a bagpipe.
Figure 2:
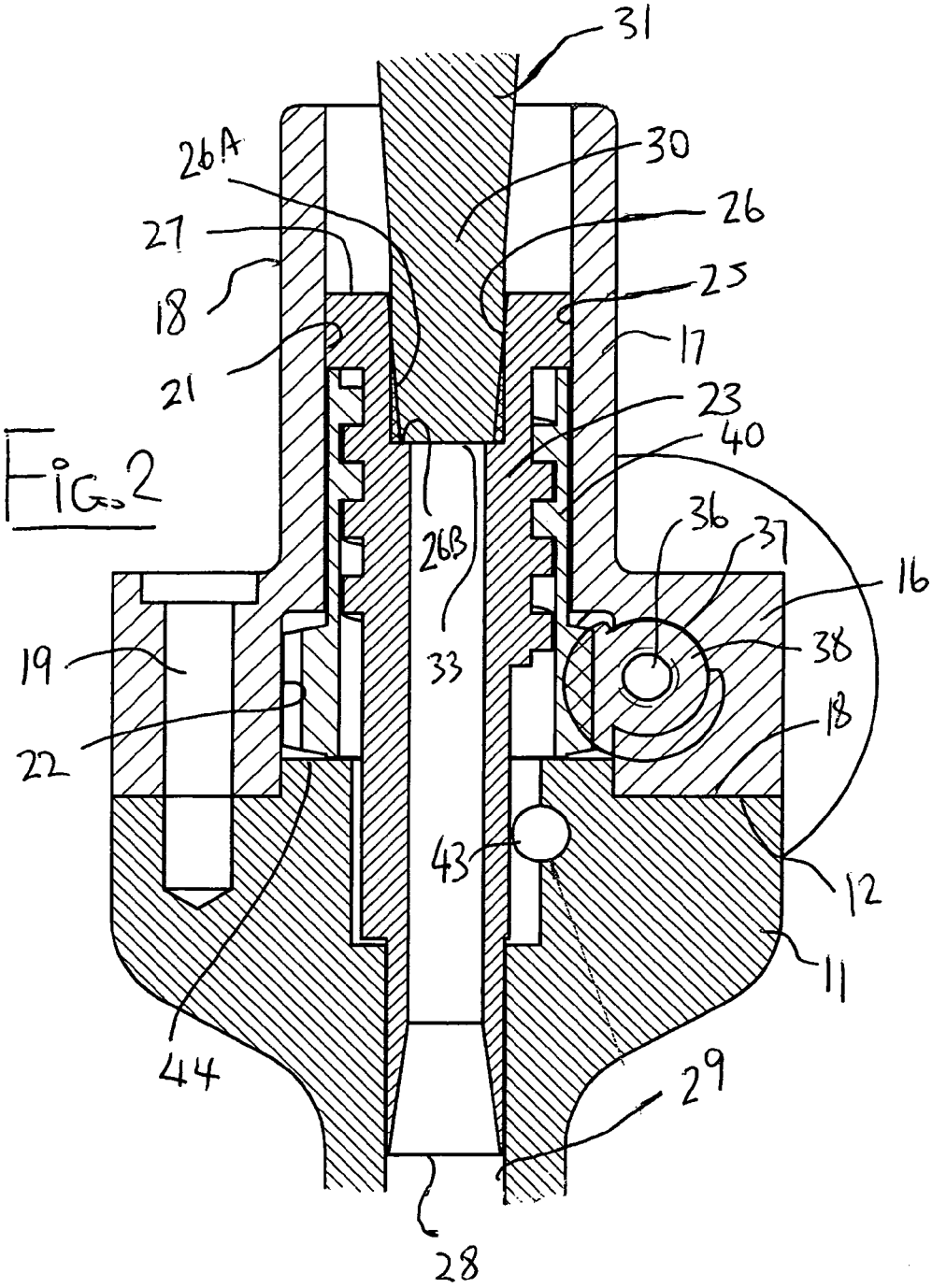
FIG. 2 is a longitudinal cross sectional view of the components when assembled of FIG. 1.
Figure 3:
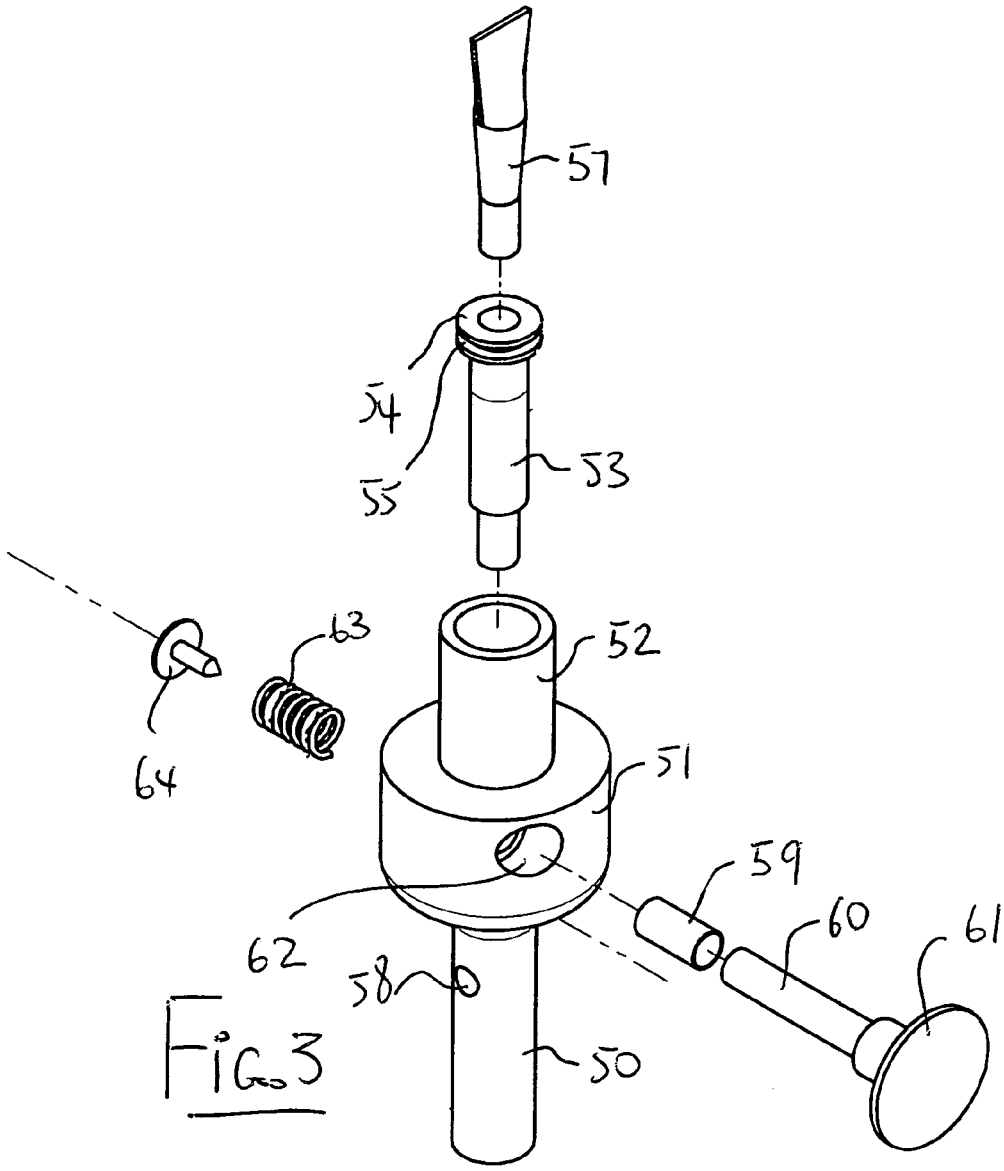
FIG. 3 is an exploded view of a second embodiment of adjustable chanter according to the present invention.
Figure 4:
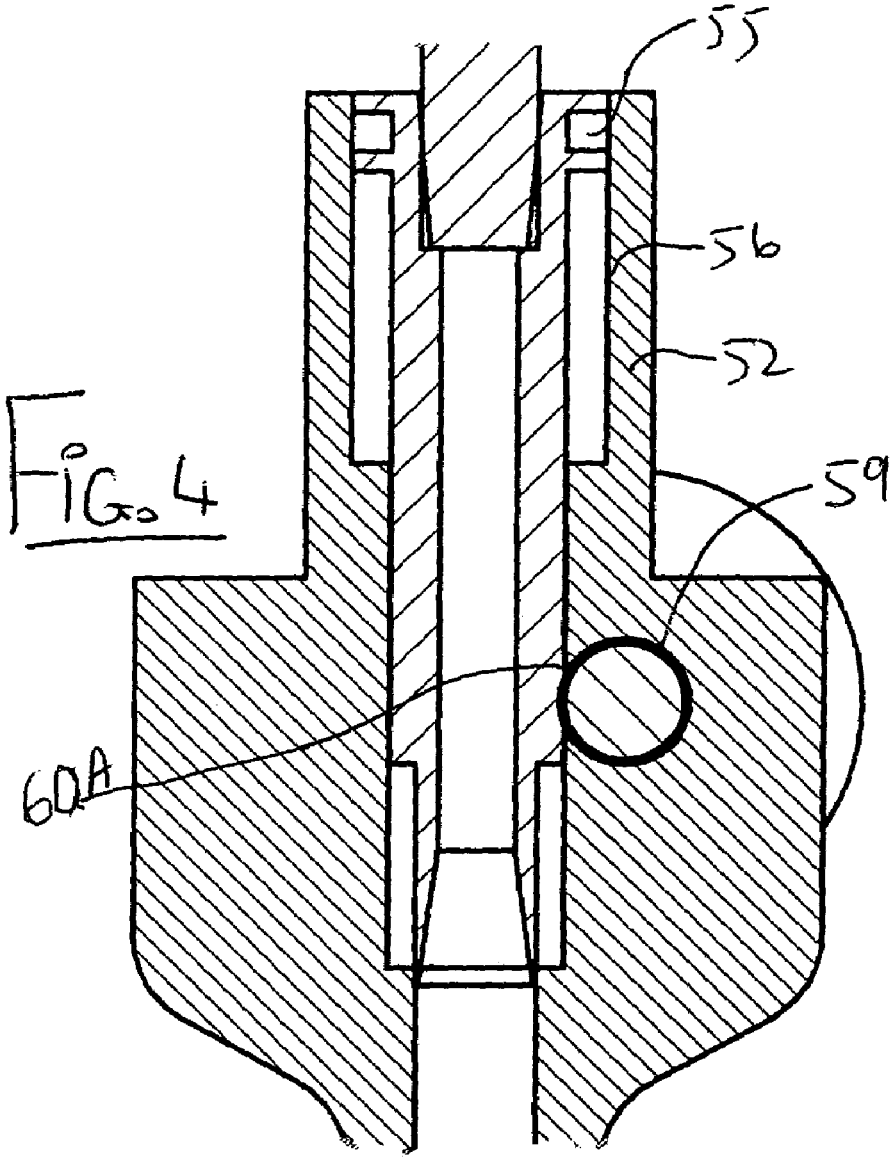
FIG. 4 is a longitudinal cross sectional view of the components of FIG. 3.

In FIGS. 1 and 2 is shown a first embodiment of adjustable chanter for a bagpipe according to the present invention. The chanter includes a chanter pipe 10 which has a collar 11 at its upper end which is conventionally used to fasten to a mounting which attaches the chanter pipe to the outlet tube of the bag. The collar 11 has an annular end face 12 with a plurality of screw holes 13. Each of the screw holes defines an axis longitudinal of the chanter pipe 10 at spaced positions around the axis of the pipe.

The chanter pipe 10 includes a plurality of holes, one of which is indicated at 14 by which the player can play the chanter pipe in conventional manner.

The structure further includes a hub generally indicated at 15 which includes a collar 16 and a tubular portion 17. The collar 16 has a flat under face 18 for attachment to the face 12 of the collar 11 of the chanter 10. The tubular member 17 has an outside surface 18 arranged for insertion as a friction fit within the outlet sleeve of a bagpipe. A screw 19 fastens the collar 16 to the collar 11 as shown in FIG. 2 and it will be appreciated that a plurality of such screws can be provided and in the example as shown in FIG. 1 there are three such screws each co-operating with a respective one of the screw holes 13 in the collar 11 and screw holes 20 in the collar 16.

Within the hollow interior of the hub 15 is provided a first cylindrical surface 21 on the inside of the tubular portion 17. At the collar 16 the cylindrical surface 21 meets a counterbore 22 of increased diameter which extends through the collar 16 to the end face 18. Within the hollow interior of the hub is provided a shuttle 23 and a pinion 24. The shuttle 23 is mounted for sliding movement in the cylindrical bore 21 and thus the shuttle includes an upper sliding surface 25 which slides on the inside surface 21. The surface 25 may include a seal (not shown). The shuttle 24 includes an inner bore 26 which extends through the shuttle from an upper end face 27 to a lower end 28 of the shuttle. Thus the shuttle provides the hollow interior bore 26 from the upper end to the lower end so that air can pass from the inside of the tubular member 17 supplied by the bag and the discharge tube therefrom through a structure and into the hollow interior 29 of the chanter pipe for playing of the chanter pipe. The bore 26 includes an upper portion 26A which extends downwardly to a shoulder 26B with the portion 26A shaped to receive the lower end 30 of a reed 31. The reed 31 is of a conventional nature with a mouth 32 at its upper end into which air flows causing the reed to generate vibration in the airflow. The lower end 30 of the reed is slightly conical so as to insert in a friction fit in the portion 26A of the interior bore of the shuttle. The arrangement of the reed and the shuttle is such that it is intended that the lower end 33 of the reed butts against the shoulder 26B to hold the reed in a fixed position relative to the shuttle.

The shuttle is movable longitudinally of the chanter within the bore so as to adjust the distance of the reed mouth 32 relative to the holes 14. This adjustment of course changes the tuning of the pipe as is well known.

Adjustment of the movement of the shuttle is effected from a device mounted on the hub 15 and projecting outwardly from the hub 15 to one side. The device forms a thumbscrew 35 which can be engaged by the fingers of the user and can be moved by the fingers while the chamfer pipe remains fixed in place on the outlet pipe of the bag.

In the embodiment shown in FIG. 1, the thumbscrew 35 is mounted on a shaft 36 which extends into a bore 37 in the collar portion 16 of the hub 15. The shaft 36 carries a worm 38 at a position on the shaft that is located within the collar portion 16. The worm 38 co-operates with a gear 39 of the pinion 24. The pinion 24 includes a tubular portion 40 which surrounds the shuttle. On the inside surface of the tubular portion 40 is provided a screw thread 41 which co-operates with a similar screw thread 42 on the exterior surface of the shuttle. A pin 43 engages the outside surface of the shuttle at a position below the hub 15 within the collar 11 of the chanter pipe with the pin acting to prevent rotation of the shuttle within the chanter pipe. Thus when the worm 38 is rotated by manual operation of the thumbscrew 35, this acts to rotate the pinion around the longitudinal axis of the chanter within the hub 15 and this in turn acts to drive the shuttle longitudinally of the hub 15 to change the distance of the mouth of the reed from the holes in the chanter pipe. The collar 11 of the chanter pipe includes a raised annular rib portion 44 which acts as a bearing surface for the bottom end face of the pinion 24.

Turning now to the figures in 3 and 4, a simplified arrangement is provided which includes the chanter pipe 50 which connects to a hub 51 carrying the tubular portion 52 which engages into the outlet tube of the bag. A shuttle 53 is mounted in the tubular portion for sliding movement as substantially as previously described. The shuttle includes an upper collar portion 54 carrying the seal 55 which slides on the inside surface 56 of the tubular portion 52. The reed 57 is mounted in the shuttle as previously described. The shuttle is movable longitudinally of the chanter pipe and the hub to change the tuning relative to the holes 58 of the chanter pipe.

In this simplified operation, the longitudinal movement of the shuttle 53 is obtained by frictional forces from a rubber sleeve 59 carried on the shaft 60 attached to the thumbscrew 61. The rubber sleeve 59 is fastened to the shaft 60 so that the rotation of the shaft causes the rubber sleeve to apply a force to an outside surface of the shuttle as indicated at 60 thus causing the shuttle to move longitudinally. The shaft 60 is mounted for movement along its length within a bore 62 of the hub 51 against resistance of a spring 53 with the shaft being held in place by a screw 64. Thus the user can pull the shaft 60 to move the rubber sleeve 59 into position in contact with the outside surface of the shuttle as indicated by 60A. In addition pushing on the shaft 60 causes the rubber sleeve to move axially away from its position of alignment with the shuttle so that the shaft 60 comes into contact with the outside of the shuttle. The shaft 60 is slightly tapered so that it locks the shuttle in the position set by rotation of the rubber screw by a frictional engagement against the outside surface of the shuttle.

Thus the user can simply adjust the tuning of the chanter by pulling the thumbscrew 61 which pulls on the shaft 60 to release the locking action and to move the rubber sleeve into place. Turning of the thumbscrew then moves the reed longitudinally to change the tuning following which the thumb screw can be pressed back into its initial position again locking the reed in the locked tuned position.

Figure 5:
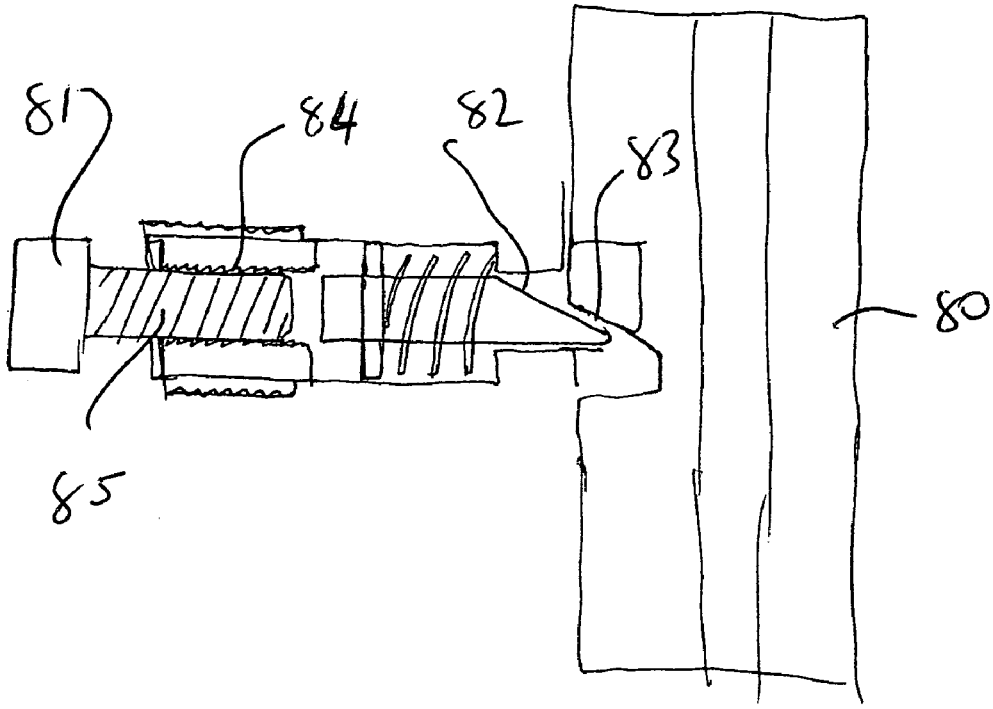
FIG. 5 is a schematic cross sectional view showing a yet further embodiment.

Yet further arrangement is shown in FIG. 5 which includes a shuttle 80 slidable within a hub (not shown). In this case the axial position of the shuttle 80 is moved by adjustment of a thumbscrew 81 which forces a wedge 82 against the surface 83 of the shuttle. Thus the user can turn the thumbscrew 81 which causes a threaded section 84 to move a forward end of the shaft 85 forwardly or rearwardly to force the shuttle longitudinally within the hub.

The arrangement described herein can provide the following features and advantages:

1. The Reed is set in place in provided reed seat
2. The Reed Seat is attached to a shuttle which is moved up or down by use of a tool to change reed pitch tone.
3. The tool will move the shuttle up or down in one of the following ways:
   a. The Shuttle has threads on the outside surface which contact the tool in a 90 degree fashion. The tool is turned in either direction which will move the shuttle up or down by means of mechanical design.
   b. The Shuttle has a slot cut into the outside surface. The tool with a cam design moves the shuttle up or down by means of mechanical design.
4. The tool can be configured in a number of ways but its main purpose is to adjust the shuttle up and down. The main design is to have the tool at a 90 degree angle to the shuttle and tube of the chanter.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A chanter for mounting in an outlet tube of a set of bagpipes comprising:

a chanter pipe having a series of finger holes by which notes can be selected;

the chanter pipe having a collar at an upper end;

a hub having a hub body for attachment to the collar;

the hub having a sleeve arranged such that the sleeve extends from the upper end of the chanter pipe for insertion into the tube of the set of bagpipes with an outer surface of the sleeve providing a friction fit within the tube such that the hub is supported in the tube for receiving air through the tube from the bag for passing through the pipe for playing the notes;

a shuttle mounted in the sleeve so as to be held in the sleeve against side to side movement within the sleeve;

the shuttle having a hollow bore therethrough to allow the air to pass from the tube to the chanter pipe;

the shuttle having an inner cylindrical surface at an upper end for engaging and receiving an outer surface of a reed, such that the reed, when inserted, is held in fixed position in the shuttle with a mouth of the reed above an upper end of the shuttle so as to supported within the tube for generating a vibration in air passing through the tube to the chanter pipe for generating the notes;

the shuttle being slidable longitudinally of the hub so as adjust the distance of the mouth of the reed from the holes in the chanter pipe to change tuning of the chanter pipe;

and an adjustment member mounted on the hub which is manually actuable by manual movement relative to the hub to drive sliding movement of the shuttle within the hub to effect the change of the tuning.

2. The chanter according to claim 1 wherein the shuttle is held against rotation relative to the hub.

3. The chanter according to claim 1 wherein the adjustment member projects outwardly to one side of the hub.

4. The chanter according to claim 1 wherein the adjustment member is rotatable about an axis transverse to the axis of the chanter pipe.

5. The chanter according to claim 1 wherein the chanter pipe is maintained in fixed position relative to the hub while the adjustment member is operated to effect the change of the tuning.

6. The chanter according to claim 1 wherein the adjustment member includes a shaft extending into the hub along an axis transverse to the axis of the chanter pipe.

7. The chanter according to claim 6 wherein the shaft carries a screw which acts to rotate a pinion within the hub, there being provided a screw coupling between the pinion and the shuttle such that rotation of the pinion drives the longitudinal movement of the shuttle.

8. The chanter according to claim 7 wherein the pinion includes a sleeve surrounding the shuttle and the screw coupling is provided between the sleeve and an outer surface of the shuttle.

9. The chanter according to claim 6 wherein the shaft carries a friction drive collar which engages an outer surface of the shuttle such that rotation of the friction drive collar against the outer surface of the shuttle acts to move the shuttle longitudinally.

10. The chanter according to claim 9 wherein the shaft is moveable along its length so as to move the friction drive collar away from the shaft and to move into engagement with the shuttle a movement locking member.

11. The chanter according to claim 1 wherein the shuttle is shaped and arranged to receive a conventional reed and to hold the reed in fixed position relative to the shuttle.

12. The chanter according to claim 1 wherein the collar of the chanter pipe is fastened to the hub by screws extending parallel to the axis of the chanter pipe.

* * * * *